United States Patent [19]

Blackman et al.

[11] Patent Number: 4,955,527

[45] Date of Patent: Sep. 11, 1990

[54] CLAMSHELL STYLE CARTON

[75] Inventors: Stephen M. Blackman, Westmont; Douglas L. Neale, Libertyville, both of Ill.

[73] Assignee: Federal Paper Board Co., Inc., Montvale, N.J.

[21] Appl. No.: 310,666

[22] Filed: Feb. 15, 1989

[51] Int. Cl.[5] ..... B65D 5/20

[52] U.S. Cl. ..... 229/114; 229/146; 229/150; 229/153; 229/906

[58] Field of Search ..... 229/112–114, 229/145, 146, 150, 153, 902, 906

[56] References Cited

U.S. PATENT DOCUMENTS

| | | | |
|---|---|---|---|
| 713,624 | 11/1902 | Ferres | 229/114 |
| 3,259,153 | 7/1966 | Haase | 229/112 |
| 3,767,108 | 10/1973 | Arneson | 229/1.5 B |
| 3,968,922 | 7/1976 | Ruud | 229/114 |
| 3,985,230 | 10/1976 | Meyer et al. | 229/112 |
| 4,266,713 | 5/1981 | Maroszek | 229/114 |
| 4,271,964 | 6/1981 | Train | 229/113 |
| 4,289,491 | 9/1981 | Collura et al. | 229/146 |
| 4,331,238 | 5/1982 | Hanko et al. | 229/146 |
| 4,516,718 | 5/1985 | Forbes, Jr. | 229/146 |
| 4,804,137 | 2/1989 | Harby | 229/114 |
| 4,836,439 | 6/1989 | Hart | 229/112 |

*Primary Examiner*—Gary E. Elkins

*Attorney, Agent, or Firm*—Brown, Charles E.; Charles A. Brown

[57] ABSTRACT

A clamshell type carton bottom having integrally connected thereto a domed top with upper portions of side and front panels of the carton bottom defining seats on which there are seated seat members carried by side and front panels of the top and reversely turned so as to slope upwardly and outwardly while the side and front panels slope downwardly and outwardly. Each side panel of the bottom adjacent the front panel of the bottom is provided with a cut line which defines stop means so as to limit the movement of the top into the bottom when the carton is being closed. Further, the bottom front panel is provided with a locking flap which carries a locking tab which engages over the front seat member of the top to lock the top in place relative to the bottom.

17 Claims, 2 Drawing Sheets

CLAMSHELL STYLE CARTON

This invention relates in general to new and useful improvements in cartons suitable for quick food products, and more particularly to a clamshell type carton having a cover hingedly connected thereto and quickly lockable in place.

Clamshell type cartons per se are old and well known, for example, in U.S. Pat. No. 3,767,108 granted to Edwin L. Arneson on Oct. 23, 1973. This invention, however, has to do with a clamshell type carton which is provided with a cover hingedly connected thereto and quickly lockable in a closed position.

Most specifically, in accordance with this invention, while the bottom of the carton has upwardly and outwardly sloping walls, it is provided with a top of a domed construction which is provided with downwardly and outwardly sloping walls. Side walls and a front wall of the bottom extend upwardly beyond the rear wall and the carton top side walls and front walls are reversely turnable upwardly and outwardly so as to seat on the upper parts of the carton bottom side walls and front wall.

Further, in accordance with this invention, the bottom side wall upper portions which form seats for the top are provided adjacent the bottom front wall with a cut out in the form of stop means for restricting the downward movement of the top into the bottom.

In addition, the reversely turned front portion of the top is provided with a central notch which receives a hinge locking tab carried by the upper portion of the bottom front wall or panel.

With the above and other objects in view that will hereinafter appear, the nature of the invention will be more clearly understood by reference to the following detailed description, the appended claims, and the several views illustrated in the accompanying drawings.

Figures 1, 2:
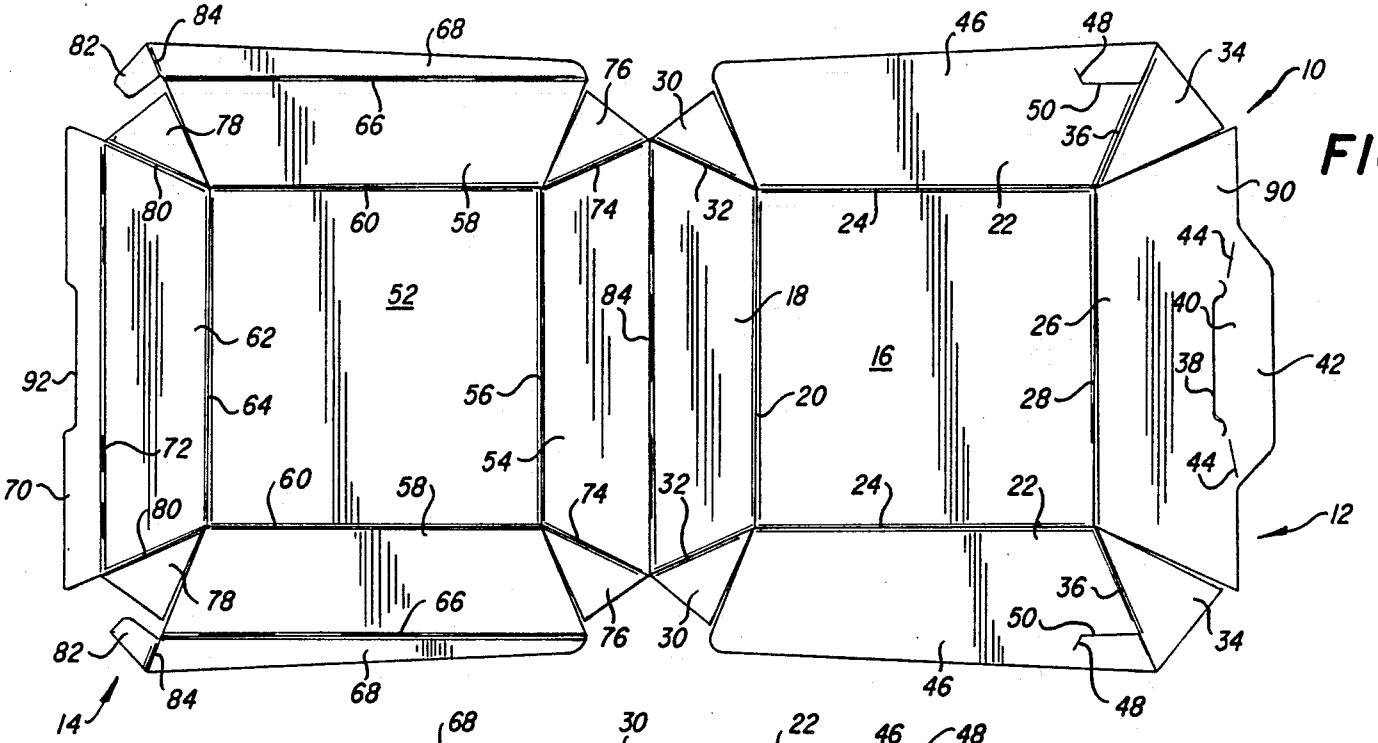
FIG. 1 is a plan view of a paperboard blank for forming the carton which is the subject of this invention.
FIG. 2 is a plan view of the erected carton formed from the blank of FIG. 1 having schematically shown positioned in the bottom thereof a fast food product.

Referring now to the drawings in detail, reference is first made to FIG. 1 wherein there is illustrated a paperboard blank from which the carton is formed, the blank being generally identified by the numeral 10. The blank 10 forms two connected units 12, 14 which are illustrated and described as including a bottom, generally identified by the numeral 12, and a top generally identified by the numeral 14. However, for descriptive and use purposes, the unit 12 may form the top of the carton while the unit 14 may form the bottom of the carton.

The top 12 includes a central base 16 which has hingedly connected to various sides thereof a rear panel 18 along a transverse fold line 20, side panels 22 along longitudinal fold lines 24 and a front panel 26 along a transverse fold line 28. At the opposite ends of the rear panel 18 there are hingedly connected corner tabs 30 along diagonal fold lines 32. Similar corner panels 34 are hingedly connected to forward ends of the side panels 22 along hinge lines 36.

The front panel 26 is provided in an outer portion thereof with a cut line 38 which defines a locking tab 40 which is part of a locking flap 42 joined to the front panel 26 along fold lines 44 beginning at opposite ends of the cut line 38.

It is to be noted that the rear panel 18 is of a free selected width. The side panels 22 are wider than the rear panel 18 so as to define upper seats 46 which increase in width from the rear of the side panels 22 to the front thereof. Further, each of the seats 46 is provided with a generally U-shaped cut line 48 which has a base portion 50 which extends along the imaginary line of separation between each seat 46 and the respective side panel 22. It will also be seen that one leg of each cut line 48 extends along the fold line 36. Each cut line 48 functions to provide stop means which will be described in more detail hereinafter.

It is to be understood that the bottom 12 is formed into a clamshell shaped carton bottom by securing the corner tabs 30 to the inner rear surfaces of the side panels 22 and the corner tabs to the inner surface of the front panel 26, as is best shown in FIG. 2.

The top 14 is of a dome shaped configuration and includes a centrally located base 52 which has integrally connected to an edge thereof a rear panel 54 along a transverse fold line 56. The top 14 also includes side panels 58 which are hingedly connected to the base 52 along fold lines 60. The top 14 also includes a front panel 62 which is hingedly connected to the base 52 along a transverse fold line 64.

It is to be noted that each of the side panels 58 carries along its outer edge thereof by way of a hinge line 66 a seat member 68. Each seat member 68 increases in width from the rear of the respective side panel 58 towards the front thereof. Further, the front panel 62 is provided with a front seat member 70 connected thereto along a transverse fold line 72. Thus the seat members 68 and 70 are reversible relative to the respective side panels 58 and front panel 62.

In order that the top 14 may be erected to its domed configuration, the rear panel 54 is provided at opposite ends thereof along diagonal fold lines 74 with corner tabs 76 which are bonded to the inner rear surfaces of the side panels 58 as is best shown in FIG. 2. The front panel 62 carries at opposite ends thereof triangular corner tabs 78 along diagonal fold lines 80. The corner tabs 78 are bonded to the inner forward surfaces of the side panels 58, as is best shown in FIG. 2.

Additionally, at the forward end of each of the side seats members 68 there is a separate corner tab 82 which is connected to the respective side seat member 68 along a diagonal fold line 84. The corner tabs 82 are bonded to the upper surfaces of the front seat members 70 as is shown in FIG. 2.

Finally, the top rear panel 54 is hingedly connected to the bottom rear panel 18 along a transverse fold line 84 so as to integrally join the top 14 to the bottom 12.

Figure 3:
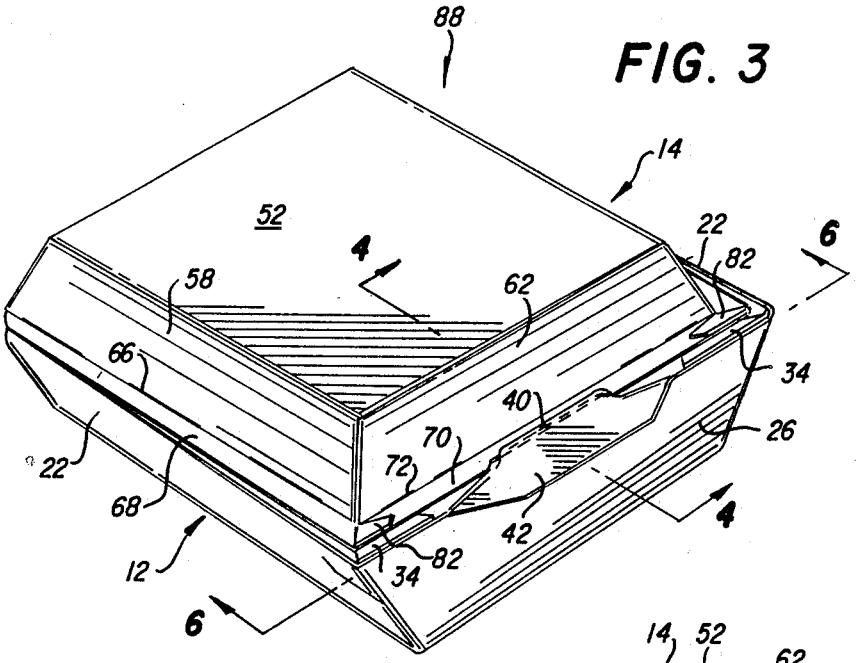
FIG. 3 is an enlarged top perspective view of the carton in its closed state.

Once the bottom 12 and the top have been erected, a product 86 may be placed within the bottom 12 and then the package sealed by folding the top 14 along the transverse fold or hinge line 84 to the closed position as is shown in FIG. 3. The completed and closed carton is generally identified by the numeral 88.

It is also to be noted that the front panel 26 is of a greater width than the rear panel 18 in the construction of the bottom 12 with the upper part of the front panel 26 defining a front seat 90.

When the top 14 is erected, the side seat members 68 and the front seat member 70 are generally reversely folded so that while the side panels 58 and the front panel 62 slope downwardly and outwardly, the side seat members 68 and the front seat member 70 slope upwardly and outwardly. Further, when the top 14 is in place relative to the bottom 12, the side seat members 68 seat on the side seats 46 of the bottom 12 while the front seat member 70 seats on the front seat 90 of the bottom 12.

It is also to be noted that the stop means defined by the cut line 48 is engaged by the front corner of each side seat member 68 so as to restrict the movement of the top 14 into the bottom 12. Such limited movement is indicated by dotted lines in FIG. 5 and clearly shown in FIGS. 4 and 6.

Figure 4:
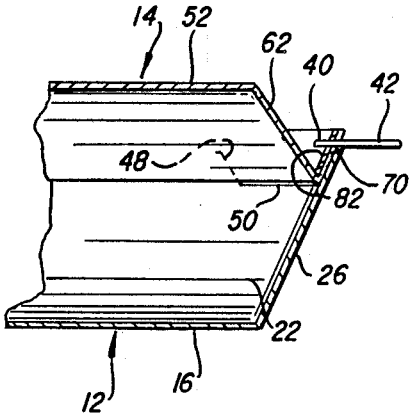
FIG. 4 is a fragmentary vertical sectional view taken generally along the line 4—4 of FIG. 3 and shows the locking relationship between the top and the bottom of the carton.
Figure 5:
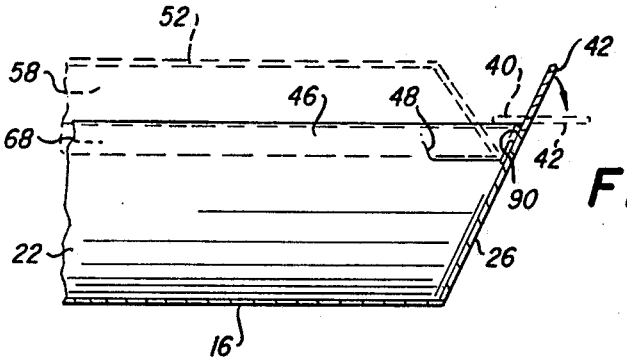
FIG. 5 is a fragmentary longitudinal sectional view similar to FIG. 4 but showing in dotted line the top as it is being pressed towards a closed position.
Figure 6:
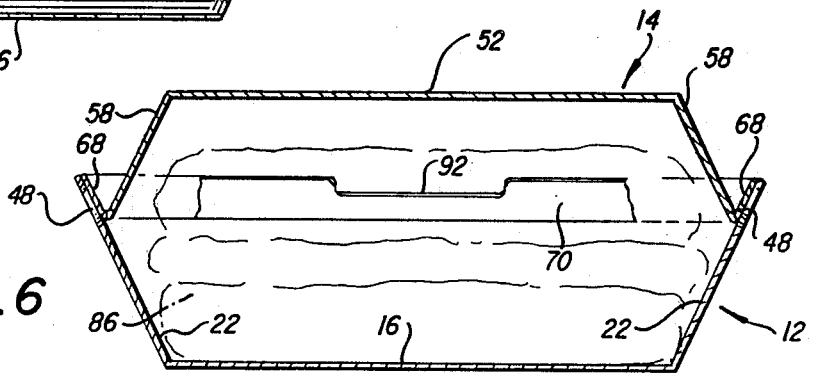
FIG. 6 is a transverse vertical sectional view taken generally along the line 6—6 of FIG. 3 and showing generally the interlock between the carton top and the carton bottom.

The top 14 is locked to the bottom 12 by pressing downwardly on the locking flap 42 as indicated by the arrow in FIG. 5 so that it swings into position through a notch 92 formed in the free edge of the front seat member 70 to a locking position as is best shown in FIG. 4 with the locking tab 40 being engaged in overlying relation to the front seat member 70.

When it is desired to open the carton 88, one merely pushes down on the locking flap 42 at which time the top 14 will swing slightly upwardly due to the resiliency of the hinge line 84.

Although only a preferred embodiment of the carton has been specifically illustrated and described herein, it is to be understood that minor variations may be made in the carton without departing from the spirit and scope of the invention as defined by the appended claims.

We claim:

1. A carton blank comprising first and second units including bottom and top units each including a base and front, rear and side panels connected to said base along fold lines, said units being hingedly joined together along a fold line joining together said rear panels, said first unit side panels being of a greater width than said first unit rear panel to form seats, and said second unit side panels carrying along fold lines disposed remote from said first unit base reversible seat members for seating on said seats, stop means being formed in each first unit side panel seat adjacent a front end portion of said seat.

2. A carton blank comprising first and second units including bottom and top units each including a base and front, rear and side panels connected to said base along fold lines, said units being hingedly joined together along a fold line joining together said rear panels, said first unit side panels being of a greater width than said first unit rear panel to form seats, and said second unit side panels carrying along fold lines disposed remote from said first unit base reversible seat members for seating on said seats, each of said seats and each of said seat members increases in width from rear to front.

3. A carton blank according to claim 2 wherein stop means are formed in each first unit side panel seat adjacent a front end portion of said seat.

4. A carton blank according to claim 3 wherein said stop means includes a cut line extending along a dividing line between each first unit side panel and a respective seat.

5. A carton blank comprising first and second units including bottom and top units each including a base and front, rear and side panels connected to said base along fold lines, said units being hingedly joined together along a fold line adjoining together said rear panels, said first unit side panels being of a greater width than said first unit rear panel to from seats, and said second unit side panels carrying along fold lines disposed remote from said first unit base reversible seat members for seating on said seats, said first unit front panel being of a greater width than said first unit rear panel to form a front seat, and said second unit front panel carrying remote from said second unit base a hinged front seat member for seating on said front seat.

6. A carton blank according to claim 5 wherein there is a corner forming tab at a forward edge of each of said seat members for joining to said front seat member.

7. A carton blank according to claim 5 wherein there is a notch in an edge of said front seat member remote from said first unit base, and said front seat member has an open notch therein for receiving a hinged locking tab carried by said front seat for locking engagement in said notch overlying said front seat member.

8. A carton comprising a clamshell first unit and a second unit, said first unit including a base and outwardly sloping first rear, front and side panels, said second unit including a base and outwardly sloping second front, rear and side panels, said first and second rear panels being connected along a fold line, said side first panels having free portions defining side seats, and said second side panels having outwardly sloping side seat members for seating on said side seats in generally sealed relation.

9. A carton according to claim 8 wherein said side seats are defined by portions of a width greater than the width of said first side panels.

10. A carton according to claim 8 wherein said side seats have stop means in end portions thereof adjacent said first front panel.

11. A carton according to claim 10 wherein said stop means is in the form of a cut line having a portion extending along the intersection of each of said side seats with a respective first side panel.

12. A carton according to claim 8 wherein said first front panel is also of a width greater than the width of said first rear panel with a portion of said first front panel defining a front seat, and said second front panel has a reversely folded outwardly sloping front seat member for seating on said front seat.

13. A carton according to claim 12 wherein a notch is formed in an edge of said front seat member, and a latch is hingedly carried by part of said front seat for engagement in said notch.

14. A carton according to claim 12 wherein a notch is formed in an edge of said front seat member, and a latch is hingedly carried by part of said front seat for engagement in said notch in overlying relation to said front seat member adjacent said notch.

15. A carton according to claim 12 wherein said second side seat members are joined to said second front seat member by corner tabs separate and apart from corner tabs joining said second front panel to said second side panels.

16. A carton according to claim 8 said first unit is a carton bottom and said second unit is a carton top.

17. A carton according to claim 8 wherein said first unit is a carton top and said second unit is a carton bottom.

* * * * *